US006336391B1

(12) United States Patent
Alm et al.

(10) Patent No.: US 6,336,391 B1
(45) Date of Patent: Jan. 8, 2002

(54) HYDRAULIC ROTATING AXIAL PISTON ENGINE

(75) Inventors: Filip Alm, Bohus; Ingvar Johansson, Hijartum, both of (SE)

(73) Assignee: Parker Hannifin A.B., Boras (SE)

( * ) Notice: Subject to any disclaimer, the term of this patent is extended or adjusted under 35 U.S.C. 154(b) by 0 days.

(21) Appl. No.: 09/585,223

(22) Filed: Jun. 1, 2000

Related U.S. Application Data

(63) Continuation of application No. PCT/SE98/02218, filed on Dec. 4, 1998.

(30) Foreign Application Priority Data

Dec. 8, 1997 (SE) ..... 9704566

(51) Int. Cl.[7] ..... F01B 3/00

(52) U.S. Cl. ..... 91/482; 91/499; 92/57; 92/71; 417/239; 417/269

(58) Field of Search ..... 417/222.1, 269, 417/239; 92/57, 71; 91/499, 482

(56) References Cited

U.S. PATENT DOCUMENTS

| | | | | |
|---|---|---|---|---|
| 3,793,924 A | | 2/1974 | Eickmann | |
| 3,999,466 A | * | 12/1976 | Aschke | 91/499 |
| 4,223,594 A | | 9/1980 | Gherner | |
| 4,920,860 A | | 5/1990 | Alm et al. | |
| 4,934,253 A | | 6/1990 | Berthold et al. | |
| 5,176,066 A | | 1/1993 | Kanamaru et al. | |

FOREIGN PATENT DOCUMENTS

| | | |
|---|---|---|
| CH | 592 812 | 11/1977 |
| EP | 0 567 805 A1 | 4/1993 |
| SE | 431 897 | 5/1984 |

OTHER PUBLICATIONS

Copy of the International Application Published Under the PCT in Case No. PCT/SE99/00186.
Copy of the International Application Published Under the PCT in Case No. PCT/SE98/02218.
Copy of the International Application Published Under the PCT in Case No. PCT/SE99/00187.

* cited by examiner

*Primary Examiner*—Timothy S. Thorpe
*Assistant Examiner*—Ehud Gartenberg
(74) *Attorney, Agent, or Firm*—Christopher H. Hunter

(57) ABSTRACT

A hydraulic rotating axial piston engine having a housing enclosing a rotatable cylinder barrel. The engine has a number of axial cylinders with a number of reciprocating pistons. The pistons reciprocate between two defined end positions, and cooperate with a plate angled relative to a rotational axis of the barrel in order to obtain the reciprocating movement. The cylinders have ports alternatively acting as inlet and outlet ports. The housing has an inlet and an outlet channel, each having a kidney shaped port, facing towards the ports of the cylinders and communicating with a number of the cylinder ports. The housing has two parts, one of the housing parts defines the turning positions of the barrel in the end positions of the pistons. A second housing part defines the turning positions of the kidney shaped ports, relative to the end positions. The first and second parts of the housing are alternatively positionable in two different turning positions in the rotational direction of the cylinder barrel. The two turning positions are two different positions deviating from a relative turning angle of 0° or 180°, so that the kidney shaped ports are displaced a predetermined extent in the rotational direction.

12 Claims, 5 Drawing Sheets

HYDRAULIC ROTATING AXIAL PISTON ENGINE

CROSS REFERENCE TO RELATED APPLICATION

This application is a continuation of copending International Application Ser. No. PCT/SE98/02218 filed Dec. 12, 1998 which designated the United States, and which claims priority to Swedish Patent Application 9704566-0, filed Dec. 8, 1997.

FIELD OF THE INVENTION

The present invention relates to hydraulic rotating axial piston engines.

BACKGROUND OF THE INVENTION

From U.S. Pat. No. 4,934,253, a pump is know that operates in either direction by means of a two part housing, including a housing part and a connection part. The connection part can be mounted in two alternative positions turned substantially through 180° about the center axis of the axial piston engine. The connecting part according to the known device is provided with four connecting holes adapted to be positioned coaxially with corresponding holes in the housing part which results in that the two alternative positions are exactly displaced relative to each other by 180°. This limits the possibilities to design the prior known pump with optimal performance with regard to capacity.

SUMMARY OF THE INVENTION

The object of the present invention is to provide a hydraulic rotating axial piston engine of the above discussed type having increased capacity in either direction of rotation.

According to the present invention, a hydraulic rotating axial piston engine is provided having a housing enclosing a cylinder barrel rotatable in two directions. The cylinder barrel has a number of axial cylinders with a number of reciprocating pistons. The pistons reciprocate between two defined end positions, and cooperate with a plate angled relative to a rotational axis for the barrel in order to obtain the reciprocating movement. The cylinders have ports alternatively acting as inlet and outlet ports. The housing has at least one inlet and outlet channel, each channel having a kidney shaped port, facing towards the ports of the cylinders and communicating with a number of the cylinder ports.

The housing has at least two parts, one of said housing parts defining turning positions of the barrel in the end positions of the pistons. A second of the housing parts defining the turning positions of the kidney shaped ports, relative to the end positions. The first and second parts of the housing being alternatively positionable in two different turning positions for the chosen rotational direction of the cylinder barrel. The two turning positions of the first and second housing parts being at least two different positions deviating from a relative turning angle of 0° or 180°, and preferably deviating 6° to 30° for one rotational direction of the cylinder barrel, and 186° to 210° for the other rotational direction of the cylinder barrel, so that the kidney shaped ports are displaced a predetermined extent in the rotational direction.

The housing parts preferably have holes in appropriate locations, and fasteners are used to fasten housing parts together in the relative rotational position.

Further features of the present invention will become apparent to those skilled in the art upon reviewing the following specification and attached drawings.

BRIEF DESCRIPTION OF THE DRAWINGS

The invention will now be described in more detail with reference to a preferred embodiment shown in the drawings, in which.

DETAILED DESCRIPTION OF THE INVENTION

Figure 1:
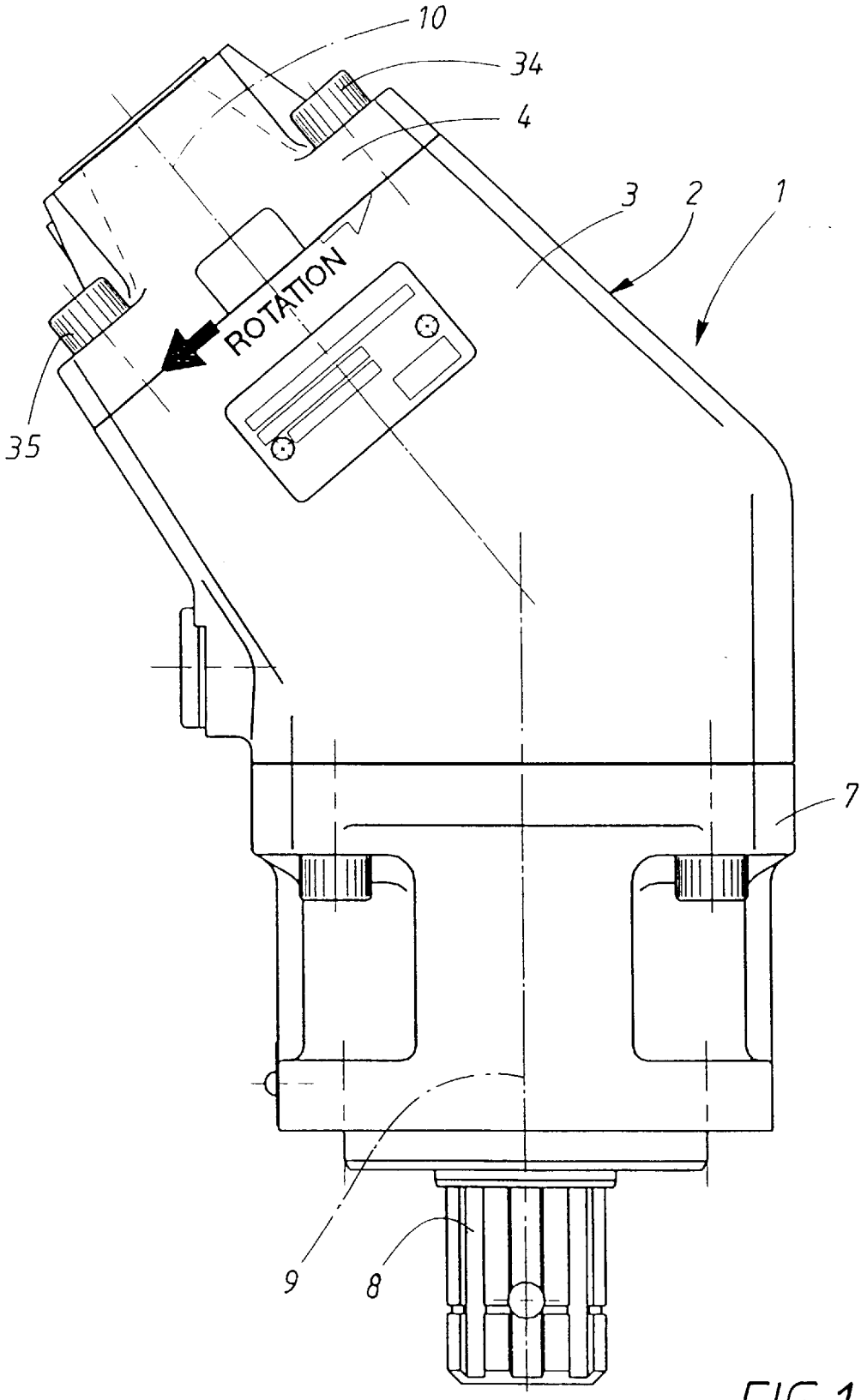
FIG. 1 shows a side view of a pump according to the present invention.
Figure 2:
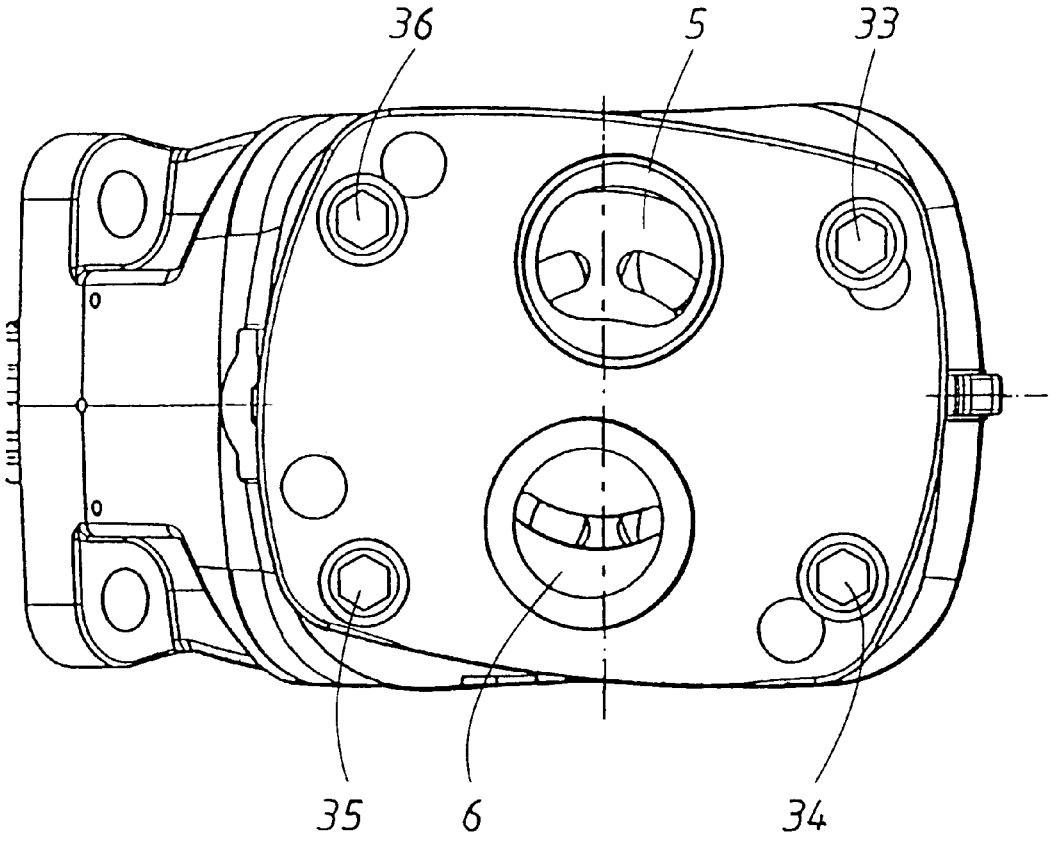
FIG. 2 is an end view of the pump.

The hydraulic rotating axial piston engine according to the present invention is shown as an embodiment in FIGS. 1 and 2 as an axial piston pump, indicated generally at 1, having a housing, indicated generally at 2. The housing 2 is comprised by at least two parts, in the shown example three parts, namely a housing part 3 and a connecting part 4. The connecting part 4 has connecting openings, namely an inlet opening 5 and an outlet opening 6 for connecting input and output conduits for hydraulic fluid to the pump. A third part 7 of the housing is a support part for the input shaft 8 which is provided to be connected with a drive motor, not shown.

Figure 3:
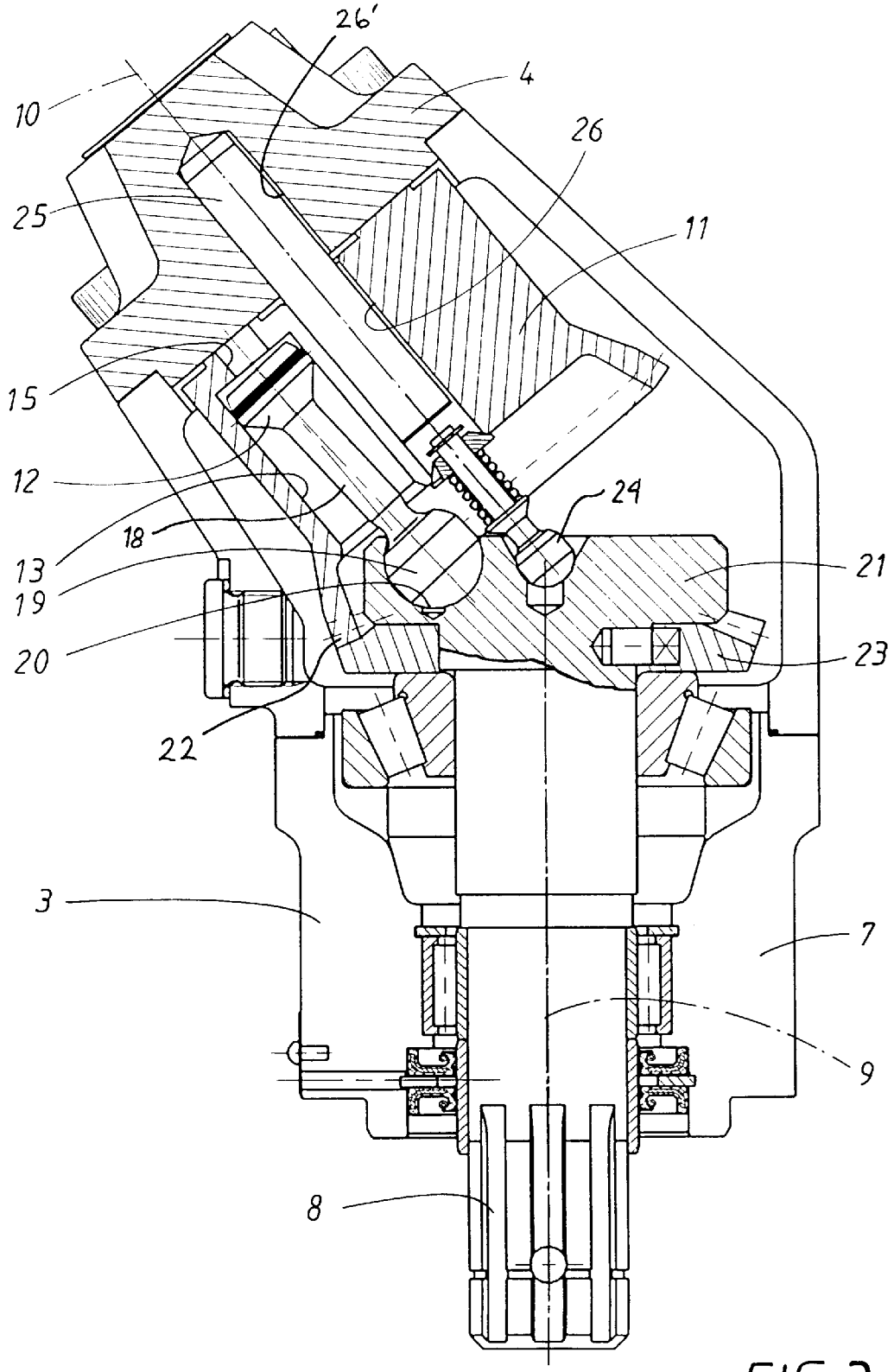
FIG. 3 is an axial section of the pump.

In FIG. 3 the general parts of the pump are shown. The pump is of a so-called bent axis type, having a rotational axis 9, forming a first rotational axis for the input shaft 8 and a second rotational axis 10 inclined relative to the first axis by an angle of 40°, for example. The second rotational axis 10 is an axis for a cylinder barrel 11 which is rotatably journalled in the housing. The cylinder barrel 11 has a number of axially extending pistons 12, movable axially, i.e. substantially in parallel with the axis 10 in a reciprocating movement in a corresponding number of cylinders 13. Cylinders 13 also extend axially with the axis 10, and are circumferentially equally-spaced along a circle line 14 (see FIG. 5). Each cylinder 13 has a fluid passage 15 with a port 16 in the planar end surface 17 of the cylinder barrel 11. Each port 16 has its largest length along the peripheral circle line 14, and is kidney-shaped.

From FIG. 3 it is further apparent that each piston 12 has a piston rod 18 with a spherical head 19, and is supported in a spherical bearing surface recess 20 in a swash plate 21. Swash plate 21 forms an integral part of the input shaft 8. The spherical recesses 20 are rotatable around a radial plane which is angled relative to the radial plane of the cylinder barrel 11, which results in the reciprocating movement of the pistons 12 and the pumping action according to a prior known principle, in order to create vacuum, i.e., suction in the inlet opening 5 and pressure in the outlet opening 6 (see for example, U.S. Pat. No. 5,176,066).

Synchronizing means are arranged in order to synchronize the rotational movements of the cylinder barrel 11 with the rotation of the swash plate 21. In the shown example the synchronizing means is made in the form of gear teeth formed by a tooth wheel rim 22 on the cylinder barrel 11 cooperating with a tooth wheel 23 of the input shaft 8. A support pin 24 supports the cylinder barrel along the axis 10 cooperating with a shaft 25 which forms the rotational axis 10. Shaft 10 projects through a bore 26 of the cylinder barrel and is supported in a bore 26' of the connecting piece 4 of the housing.

Figure 4:
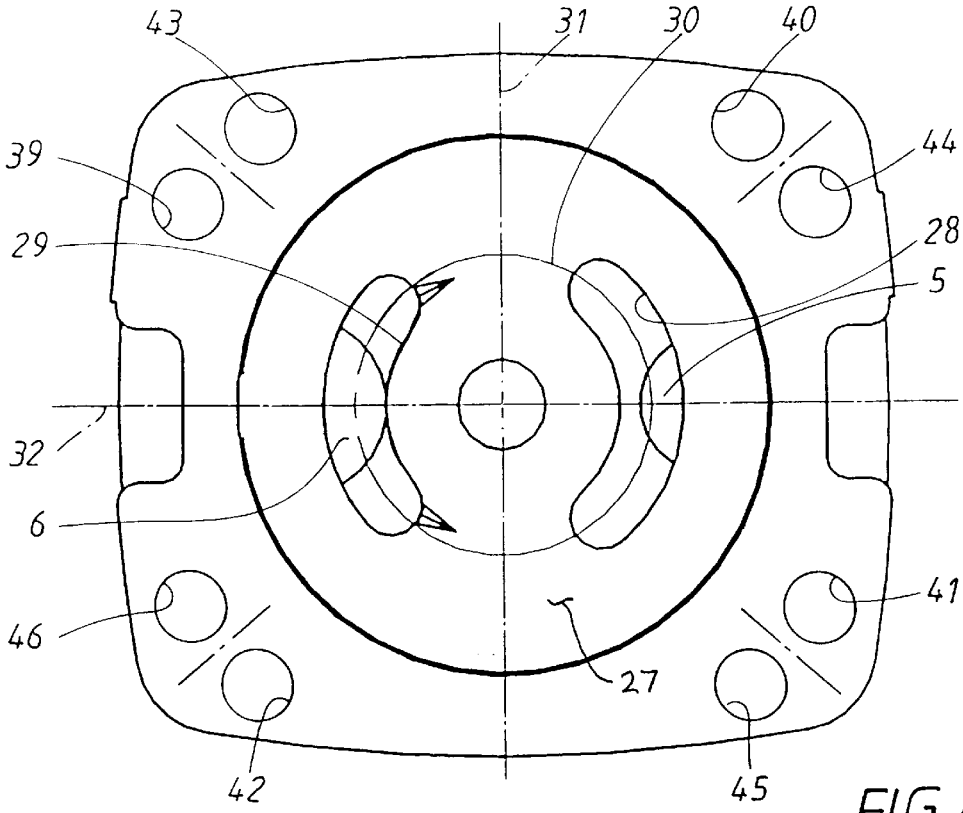
FIG. 4 is a plan view of a connecting part of the pump as seen separately from the inside.

FIG. 4 shows the connecting part 4 of the housing separately and from the inside. The connecting part 4 has on its inside a substantially planar, circular surface 27 which in the mounted position is facing the planar surface 17 of the cylinder barrel 11. The two planar surfaces 17, 27 are arranged to contact each other with a sealing fit. On its inside the connecting part 4 is provided with one inlet port 28 and one outlet port 29, which are kidney-shaped. The inlet port 28 communicates through a channel with the inlet opening 5, and the outlet port 29 communicates through a separate channel with the outlet opening 6 on the outside of the connecting part 4. The inlet and outlet ports 28, 29 extend along a peripheral circle line 30 which has a corresponding radius as the circle line 14 of the openings 16 of the cylinder barrel 11. The inlet and outlet opening 28, 29 extend on each half of said circle line 30, separated by a main plane 31 extending through the connecting part 4. The inlet and outlet ports 28, 29 are further divided by a second main plane 32 extending 90° relative to the first main plane 31. One of these main planes is normally a symmetrical plane for the connecting part 4. The inlet and outlet ports 28, 29 further extend along the circle line 30 along a predetermined peripheral angle which in the shown example is somewhat larger for the inlet opening 5 than for the outlet opening 6, and are arranged so that simultaneously more than one cylinder port 16 communicates with the inlet port 28 and the inner outlet port 29, respectively.

According to the present invention, the connecting part 4 of the housing 2 is arranged to be mounted in at least two alternative positions in order to enable the pump to be operated by rotating the input shaft in two alternative directions of rotation. According to the present invention, it has been discovered that the flow capacity of the pump can be increased by extending the kidney-shaped inlet port 28 of the connecting part 4 in the chosen rotational direction of the cylinder barrel so that the cylinder ports 16 are open to the kidney-shaped inlet port 28 even when the corresponding piston 12 passes its lower dead center. According to the present invention, this is accomplished by the two alternative mounting positions of the connecting part 4 deviating from each other by a relative turning angle $\alpha$ of 6° to 30°, or alternatively, a turning angle $\beta$ of 186° to 210° (that is, 180° from $\alpha$), so that the kidney-shaped ports 28, 29 are displaced a predetermined extent in the respective rotational direction. This is preferably accomplished by enabling the fastening means 33, 34, 35, 36 between the connecting part 4 and the housing part 3 to fasten the connecting part in at least two alternative positions, so that the connecting part can be displaced according to the above intervals.

Main plane 37 is defined by the upper and lower dead centers of the pistons 12, and main plane 31 is corresponding to this. Consequently, the main planes 31, 32 can be in two alternative positions displaced by substantially half of the above intervals relative to the two main planes 37, 38 defined for the housing part (see FIGS. 5 and 6). Main plane 38 extends 90° relative to main plane 37. FIG. 6 shows the different mounting positions of the connecting part 4. All main planes 31, 32, 37, 38 are crossing in the rotational axis of the cylinder barrel 11.

Figure 5:
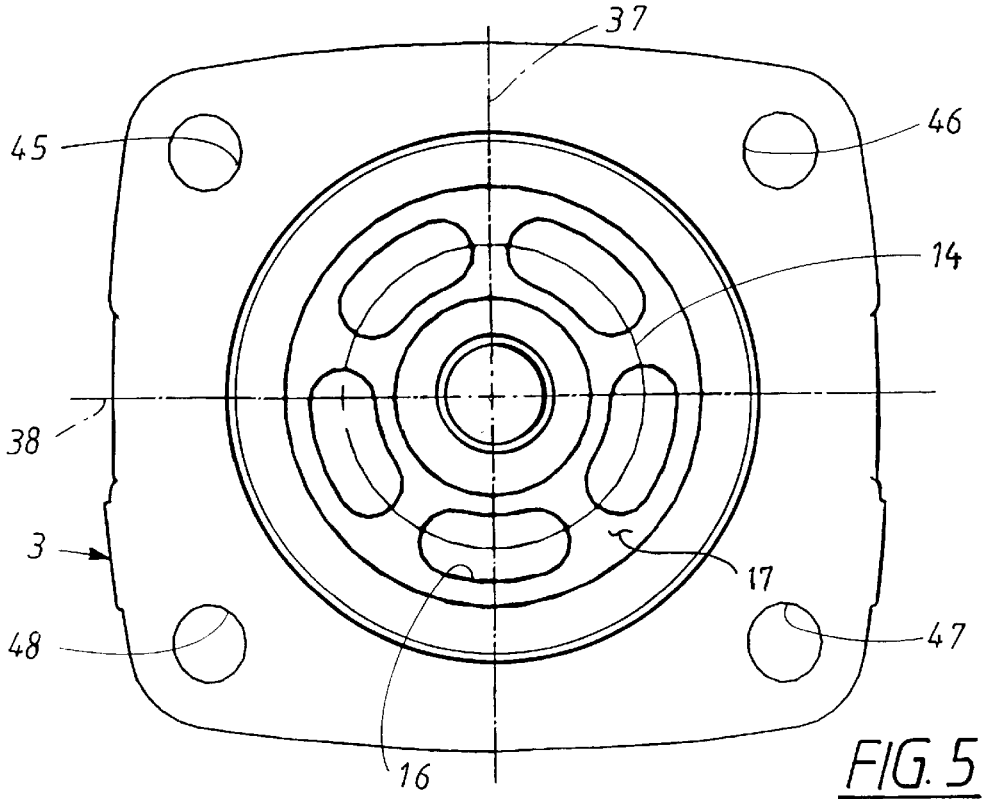
FIG. 5 is an end view of a modified embodiment of a housing part of the pump according to FIG. 1.
Figure 6:
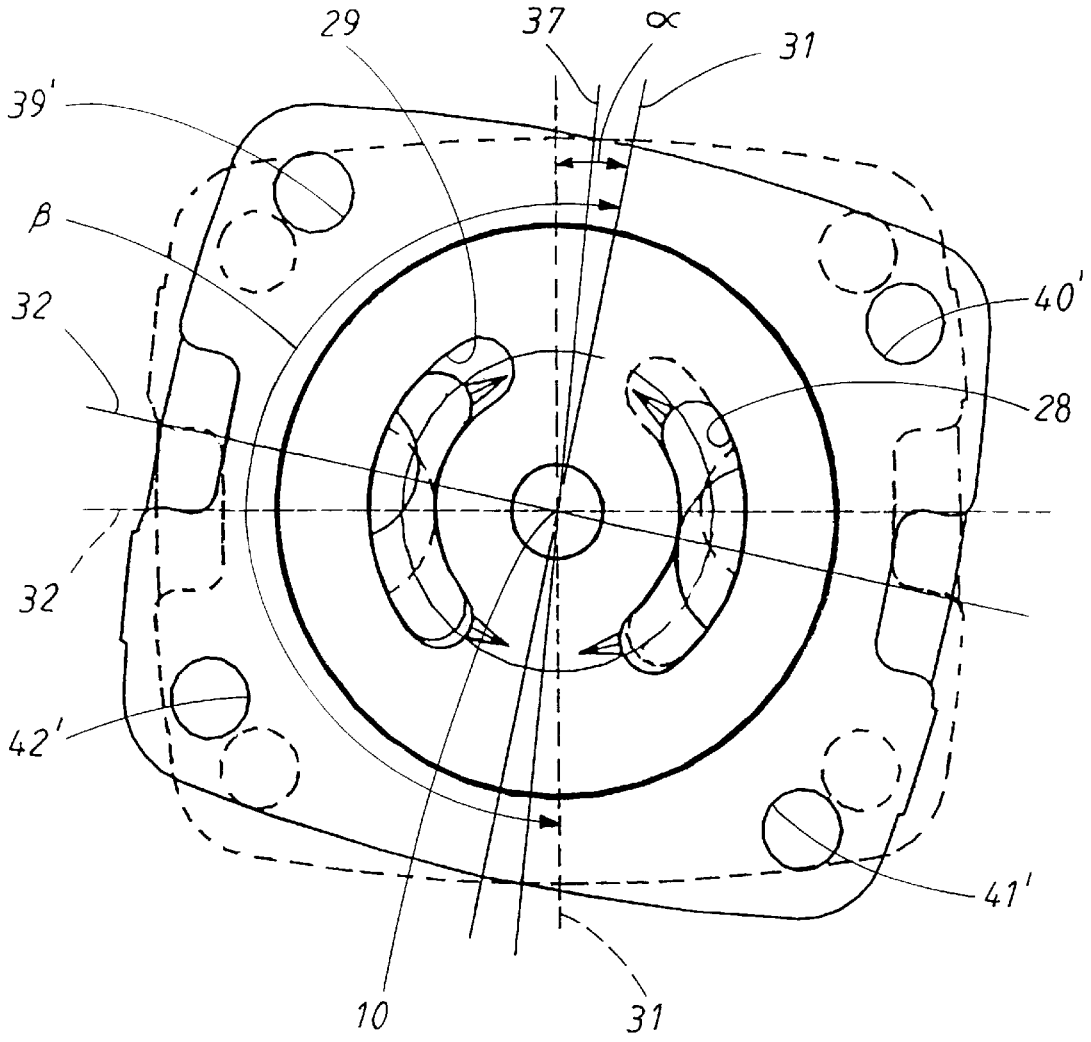
FIG. 6 is an end view of the connecting part of the pump, showing two alternative turning positions of the connecting part.

The fastening means 33–36 are preferably screws extending through two alternative sets of holes 39–42 and 43–46, respectively in the connecting part 4 and one set of holes 45–48 in the housing part 3, as seen in FIGS. 4 and 5; or reversely, as seen in FIG. 6. Consequently in the embodiment of FIG. 6, the connecting part 4 has one set of holes 39'–42' and the housing part 3 has two sets of holes (not shown). In the embodiment shown in FIG. 2, the fastening means 33–36 with their alternative sets of holes 39–42 and 43–46 lack symmetry with respect to their mutual positions in the connecting part as well as the housing part 3. Merely two alternative positions are possible in this embodiment. In the modified embodiment shown in FIGS. 4–6, all holes are symmetrical with respect to their mutual positions. Four alternative positions are possible in this embodiment. Alternatively, the double holes can be replaced by oblong holes enabling that the connecting part can be positioned in a large number of positions within the defined angular intervals.

In the above embodiments the engine has been described as a pump, having an input shaft for a motor. The same principle can be used for an engine acting as a motor, driven by a hydraulic fluid, whereas the shaft 8 acts as an output shaft for driving a rotating engine, for example a drilling engine.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A hydraulic rotating axial piston engine, having a housing enclosing a cylinder barrel rotatable in two directions, the cylinder barrel having a number of axial cylinders with a number of reciprocating pistons, said pistons reciprocating between two defined end positions, said pistons cooperating with a plate angled relative to a rotational axis for the barrel in order to obtain said reciprocating movement, said cylinders having ports alternatively acting as inlet and outlet ports, said housing having at least one inlet and outlet channel, each channel having a kidney shaped port, facing towards said ports of said cylinders and communicating with a number of said ports, said housing having at least two parts, one of said housing parts defining turning positions of the cylinder barrel in said end positions of said pistons, a second of said housing parts defining turning positions of the kidney shaped ports relative to said end positions, said first and second parts of said housing being alternatively positionable in two different turning positions for the chosen rotational direction of the cylinder barrel, wherein said two turning positions are at least two different positions deviating from a relative turning angle so that the kidney shaped ports are displaced a predetermined extent from the relative turning angle in the rotational direction.

2. A hydraulic rotating axial piston engine according to claim 1, wherein said deviating angle is between 6°–30° for one rotational direction of the cylinder barrel, and 186°–210° for the other rotational direction of the cylinder barrel.

3. A hydraulic rotating axial piston engine according to claim 1, wherein said second housing part is an end part, having a number of fastening means for fastening said second housing part relative to said first housing part in the relative turning positions.

4. A hydraulic-rotating axial piston engine according to claim 3, wherein said fastening means includes screws and holes in said first and second housing parts, said holes being two for each screw, a first of said holes defining a first of said turning positions, and a second of said holes defining the second of said turning positions.

5. A hydraulic rotating axial piston engine according to claim 4, wherein said holes are positioned without symmetry, involving that the second housing part can be mounted in merely two alternative positions.

6. A hydraulic rotating axial piston engine according to claim 4, wherein said fastening means includes screws and holes in said first and second housing parts, said holes being oblong holes, defining said at least two different turning positions.

7. A hydraulic rotating axial piston engine as in claim 1, wherein said engine is a pump, having an input shaft for a motor.

8. A hydraulic rotating axial piston engine as in claim 1, wherein said engine is a motor, having an output shaft for driving a rotating engine.

9. A hydraulic rotating axial piston engine, comprising:

a housing assembly enclosing a cylinder barrel rotatable in two directions, the cylinder barrel having a number of axial cylinders with a number of reciprocating pistons, said pistons reciprocating between an upper dead center and a lower dead center end position, said pistons cooperating with a plate angled relative to a rotational axis for the barrel in order to obtain said reciprocating movement, said cylinders having ports alternatively acting as inlet and outlet ports, said housing assembly having a housing part and a connecting part, the connecting part having at least one inlet and outlet channel, each channel having a kidney shaped port, facing towards said ports of said cylinders and communicating with a number of said ports, said housing part defining turning positions of the cylinder barrel in said end positions of said pistons, the connecting part defining turning positions of the kidney shaped ports relative to said end positions, said housing part and connecting part of said housing being relatively positionable in at least two different turning positions, said at least two different positions deviating from a relative turning angle so that the kidney shaped ports are displaced a predetermined extent from the relative turning angle in the rotational direction, and fastening means for fastening said connecting part relative to said housing part in the relative turning positions.

10. A hydraulic rotating axial piston engine according to claim 9, wherein said deviating angle is between 6°–30° for one rotational direction of the cylinder barrel, and 186°–210° for the other rotational direction of the cylinder barrel.

11. A hydraulic-rotating axial piston engine according to claim 9, wherein said fastening means includes fasteners and holes in said connecting and housing parts.

12. A hydraulic rotating axial piston engine, comprising:

a housing assembly enclosing a cylinder barrel rotatable in two directions, the cylinder barrel having a number of axial cylinders with a number of reciprocating pistons, said pistons reciprocating between an upper dead center and a lower dead center end position, said pistons cooperating with a plate angled relative to a rotational axis for the barrel in order to obtain said reciprocating movement, said cylinders having ports alternatively acting as inlet and outlet ports, said housing assembly having a main housing part and an end connecting part, the end connecting part having at least one inlet and outlet channel, each channel having a kidney shaped port, facing towards said ports of said cylinders and communicating with a number of said ports, said main housing part and said end connecting part being relatively positionable in two different rotational positions relative to each other so that the kidney shaped ports can be displaced a predetermined extent from a relative turning angle in the rotational direction, said deviating angle being between 6°–30° for one rotational direction of the cylinder barrel, and 186°–210° for the other rotational direction of the cylinder barrel, and fastening means for fastening said connecting part relative to said housing part in the relative rotational positions.

* * * * *